US008777826B2

(12) United States Patent
Totani

(10) Patent No.: US 8,777,826 B2
(45) Date of Patent: Jul. 15, 2014

(54) PLASTIC BAG MAKING APPARATUS

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 711 days.

(21) Appl. No.: 13/019,608

(22) Filed: Feb. 2, 2011

(65) Prior Publication Data

US 2012/0035035 A1 Feb. 9, 2012

(30) Foreign Application Priority Data

Feb. 5, 2010 (JP) ..... 2010-024002

(51) Int. Cl.
*B31B 37/00* (2006.01)

(52) U.S. Cl.
CPC ..... *B31B 37/00* (2013.01); *B31B 2221/20* (2013.01); *B31B 2237/20* (2013.01); *B31B 2237/50* (2013.01)
USPC ..... 493/193; 493/196; 493/201; 493/213; 493/231; 493/235; 493/239; 493/243; 493/246; 493/379

(58) Field of Classification Search
CPC .... B31B 29/00; B31B 37/00; B31B 2221/20; B31B 2221/40; B31B 2221/402; B31B 2221/405; B31B 2221/407; B31B 2237/20; B31B 2237/50; B31B 2237/60
USPC ..... 493/193, 210, 218, 231, 233, 243–245, 493/356, 360, 379–381, 391, 918, 194–196, 493/199, 200, 201, 213, 223, 224, 227, 235, 493/239, 246, 343–346, 357, 361, 362, 374
See application file for complete search history.

(56) References Cited

U.S. PATENT DOCUMENTS

| | | | | | |
|---|---|---|---|---|---|
| 3,380,646 | A * | 4/1968 | Doyen et al. | 383/104 |
| 4,055,109 | A * | 10/1977 | Kan | 493/196 |
| 4,696,050 | A * | 9/1987 | Sengewald | 493/200 |
| 5,788,378 | A * | 8/1998 | Thomas | 383/63 |
| 6,425,847 | B1 * | 7/2002 | Broenstrup | 493/231 |
| 6,740,020 | B2 * | 5/2004 | Horibe et al. | 493/218 |
| 6,796,932 | B2 * | 9/2004 | Kuge et al. | 493/218 |
| 7,156,556 | B2 * | 1/2007 | Takahashi et al. | 383/104 |
| 7,331,917 | B2 * | 2/2008 | Totani | 493/244 |
| 7,497,624 | B2 * | 3/2009 | Totani | 383/120 |
| 2011/0015052 | A1 * | 1/2011 | Totani | 493/189 |
| 2011/0039676 | A1 * | 2/2011 | Totani | 493/227 |

FOREIGN PATENT DOCUMENTS

| | | | | |
|---|---|---|---|---|
| DE | 1234003 B | * | 2/1967 | B31B 2221/20 |
| EP | 2277790 | | 1/2011 | |
| EP | 2279857 | | 2/2011 | |
| JP | 2000-153849 | | 6/2000 | |
| WO | 2004/009341 | | 1/2004 | |
| WO | 2004007307 | | 1/2004 | |

* cited by examiner

*Primary Examiner* — Stephen F Gerrity
(74) *Attorney, Agent, or Firm* — Kirschtein, et al.

(57) ABSTRACT

Plastic bags are successively made by intermittently feeding upper and lower panel material webs that are temporarily fixed to side gusset material layers. The webs are joined along a joint line. One web is folded along a first line spaced from the joint line to open the webs and form a surface on the webs. One gusset layer is folded along the first line to open the gusset layers along with an auxiliary gusset portion and form a surface on the layers of the auxiliary gusset portion. One web is turned along a turned line formed between the joint line and the first line to make a turned portion formed in one web and superimposed on the surfaces. The other web is folded along a second line spaced from the joint line to make a folded portion in the other web and superposed on the surfaces.

9 Claims, 13 Drawing Sheets

PLASTIC BAG MAKING APPARATUS

TECHNICAL FIELD

The invention relates to an apparatus for successively making plastic bags.

BACKGROUND

There has heretofore been proposed a plastic bag including panel portions, side gusset portions and a bottom gusset portion, as disclosed in Japanese Patent Publication No. 3,655,627. Each of the panel portions has opposite side edges along which the side gusset portions extend. Each of the panel portions further has opposite end edges along one of which the bottom gusset portion extends. Each of the side gusset portions has opposite end portions at one of which an auxiliary gusset portion is formed. The bottom gusset portion is combined with the auxiliary gusset portion. The plastic bag can therefore be enlarged by the side gusset portions to obtain an increased capacity. A flat bottom surface can be formed by the bottom gusset portion to make the plastic bag stand stably. The plastic bag is called a rectangular bottom bag.

In addition to the side gusset portions and the bottom gusset portion, the plastic bag may further include an additional bottom gusset portion, as disclosed in Japanese Patent Publication No. 4,108,846. The bottom gusset portion extends along one of the end edges of panel portion while the additional bottom gusset portion extends along the other end edge. In addition to the auxiliary gusset portion formed at one of the end portions of side gusset portion, an auxiliary gusset portion is formed at the other end portion. The additional bottom gusset portion is combined with the auxiliary gusset portion. In this case, the plastic bag can be shaped into a rectangular parallelepiped to have an appearance of box when being filled with content. A flat top surface is formed by the bottom gusset portion while a flat bottom surface is formed by the additional bottom gusset portion. The plastic bag is therefore high in efficiency of being filled. The plastic bags can be pilled up conveniently.

The plastic bag of each of the publications is therefore expected to be used widely in the future. In this connection, it is desired to make the plastic bag have an added value. In particular, it is desired to make the plastic bag include an opening in position for discharge of content.

It is therefore an object of the invention to provide a new and improved apparatus for successively making plastic bags each of which is called a rectangular bottom bag.

Another object is to make the plastic bag include an opening in position.

SUMMARY OF THE INVENTION

According to the invention, the apparatus is arranged to successively make plastic bags each of which includes panel portions, side gusset portions and a bottom gusset portion. Each of the side gusset portions has opposite end portions at one of which an auxiliary gusset portion is formed. The bottom gusset portion is combined with the auxiliary gusset portion. The plastic bag further includes an opening formed between bottom protrusions protruding from the bottom gusset portion.

The apparatus includes panel material feeding means by which upper and lower webs of panel material are opposed to and superposed on each other and fed longitudinally thereof and intermittently. Each of the webs of panel material has opposite side edges. The panel portions are formed by the webs of panel material. The apparatus further includes side gusset material supply means by which a sheet of side gusset material is folded into halves, superposed into two layers and then supplied to and interposed between the webs of panel material to extend widthwise thereof whenever the webs of panel material are fed intermittently. The sheet of side gusset material has opposite end portions one of which is spaced from one of the side edges of panel material. The side gusset portion and the auxiliary gusset portion are formed by the sheet of side gusset material. The apparatus further includes temporarily fixing means by which one of the webs of panel material is temporarily fixed to one of the layers of side gusset material, the other web of panel material being temporarily fixed to the other layer of side gusset material, at one of the end portions of side gusset material after the sheet of side gusset material is interposed. The apparatus further includes joint means by which the webs of panel material are joined to each other along a longitudinal joint line predetermined adjacent to one of the side edges of panel material. The apparatus further includes guide means by which each of the webs of panel material is guided to be deformed from one of the side edges thereof after being temporarily fixed and joined and when being fed so that one of the webs of panel material can be folded along a longitudinal first folded line spaced from the longitudinal joint line to make the webs of panel material open and make an open surface formed on the webs of panel material. One of the layers of side gusset material is folded along the longitudinal first folded line to make the layers of side gusset material open along with the auxiliary gusset portion and make an open surface formed on the layers of auxiliary gusset portion. One of the webs of panel material is turned along a longitudinal turned line formed between the longitudinal joint line and the longitudinal first folded line to make a turned portion formed in one of the webs of panel material and superposed on the open surfaces of the webs of panel material and the layers of auxiliary gusset portion. The other web of panel material is folded along a longitudinal second folded line spaced from the longitudinal joint line to make a folded portion formed in the other web of panel material and superposed on the open surfaces of the webs of panel material and the layers of auxiliary gusset portion. The bottom gusset portion is formed by the turned portion and the folded portion. The opening is formed between the bottom protrusions which are formed between ones of the side edges of panel material and the longitudinal joint line.

In a preferred embodiment, one of the webs of panel material is folded along the longitudinal first folded line and folded back along a longitudinal folded back line to make a folded back portion formed in one of the webs of panel material. The turned portion comprises the folded back portion. The longitudinal turned line comprises the longitudinal folded back line.

One of the webs of panel material may be slit along a longitudinal slit line after being temporarily fixed and joined. One of the webs of panel material is then folded along the longitudinal first folded line. The turned portion is formed between the longitudinal joint line and the longitudinal slit line. The longitudinal turned line comprises the longitudinal slit line.

The apparatus further includes cross seal means by which the webs of panel material and the sheet of side gusset material are heat sealed with each other widthwise of the webs of panel material after the webs of panel material are folded and turned and whenever the webs of panel material are fed intermittently.

The apparatus further includes additional bottom gusset material supply means by which a web of additional bottom gusset material is supplied to and interposed between the webs of panel material to extend longitudinally thereof.

The apparatus further includes longitudinal seal means by which the webs of panel material and the web of additional bottom gusset material are heat sealed with each other longitudinally of the webs of panel material whenever the webs of panel material are fed intermittently. The plastic bag further includes an additional bottom gusset portion formed by the web of additional bottom gusset material.

The apparatus further includes a cutter by which the webs of panel material are cut widthwise thereof after the webs of panel material are heat sealed and whenever the webs of panel material are fed intermittently.

The apparatus further includes zipper supply means by which a zipper is supplied to and interposed between the webs of panel material to extend along the longitudinal joint line. The joint means comprises zipper seal means by which the webs of panel material and the zipper are heat sealed with each other so that the webs of panel material can be joined to each other. The opening is formed by the zipper.

The joint means may comprise spot seal means by which the webs of panel material are spot sealed with each other to be joined to each other at a position corresponding to the sheet of side gusset material whenever the webs of panel material are fed intermittently. The opening is formed between points at which the webs of panel material are spot sealed.

The longitudinal first folded line is spaced from the longitudinal joint line at a first distance. The longitudinal turned line is spaced from the longitudinal joint line at a second distance. The longitudinal second folded line is also spaced from the longitudinal joint line at the second distance. The second distance is half of the first distance. The sheet of side gusset material extends widthwise of the webs of panel material so that one of the end portions of side gusset material can be spaced from the longitudinal join line at the second distance.

BEST MODE TO CARRY OUT THE INVENTION

Embodiments of the invention are as follows.

Figure 1:
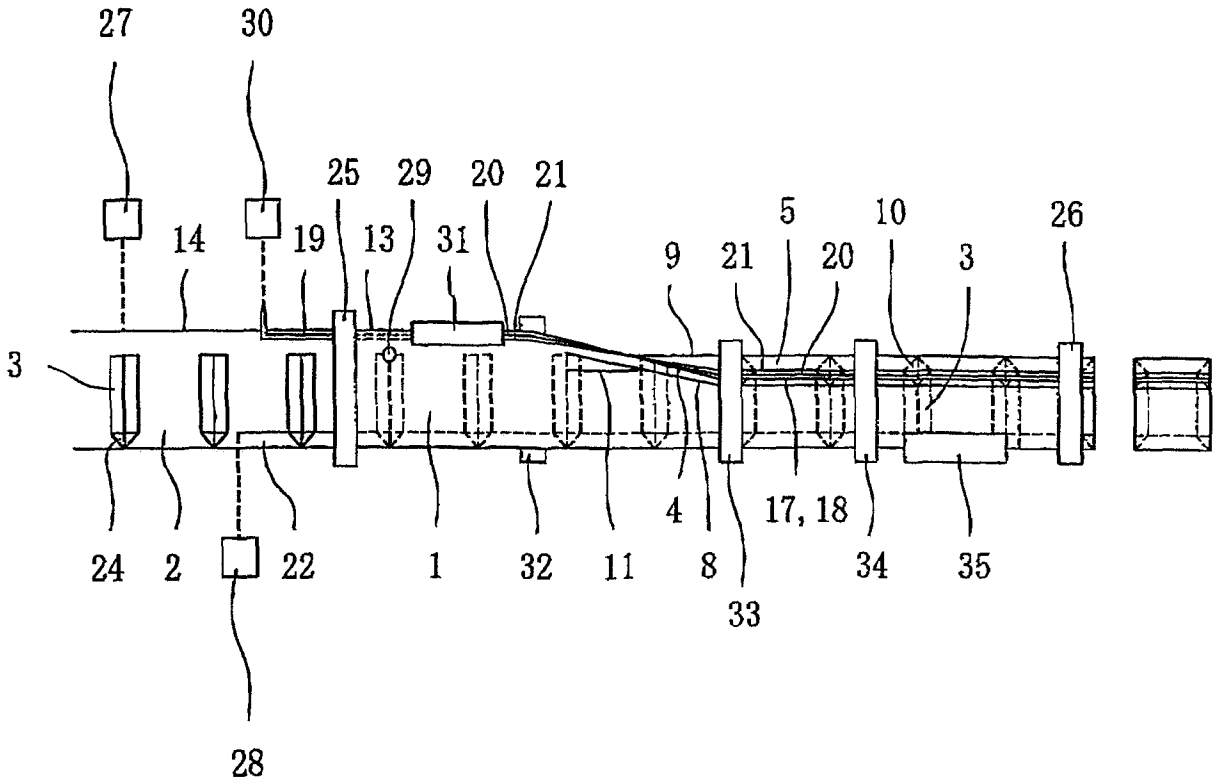
FIG. 1 is a plan view of a preferred embodiment of the invention.
Figure 3:
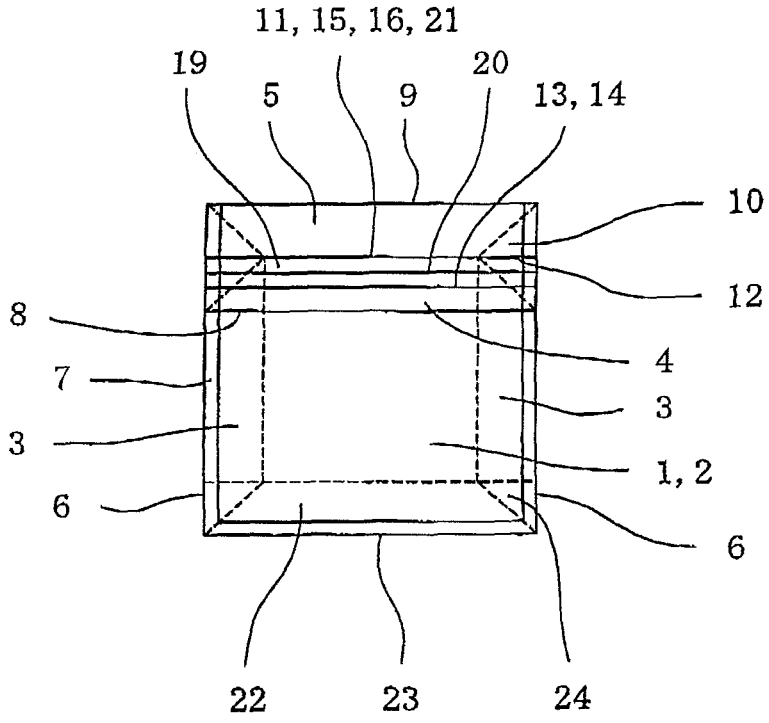
FIG. 3 is an explanatory view of a plastic bag obtained by the apparatus of FIG. 1.
Figure 4:
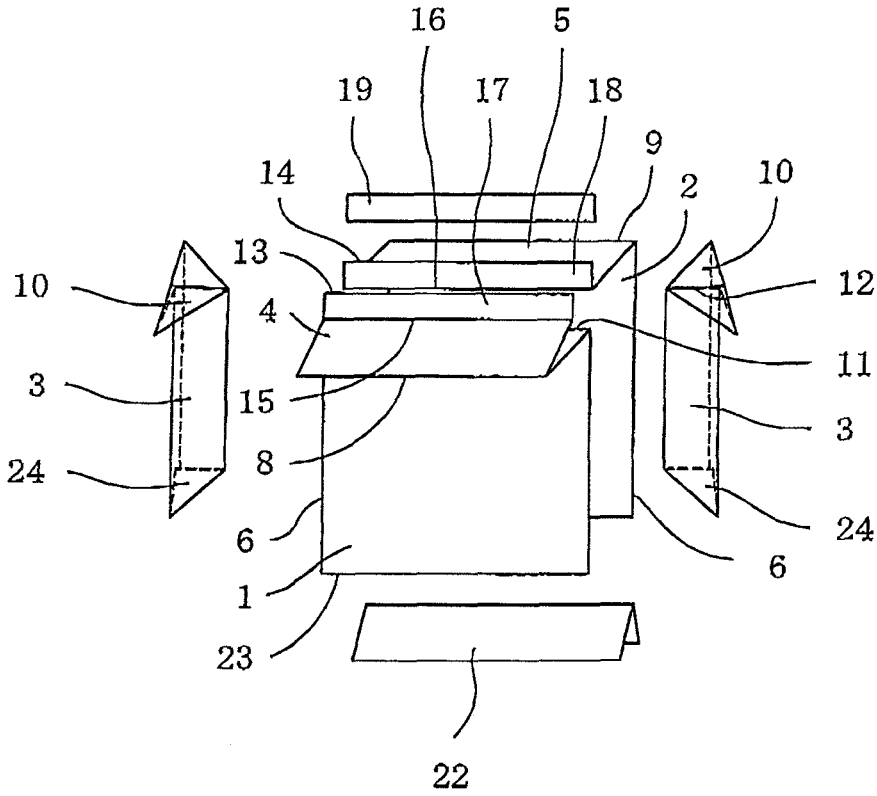
FIG. 4 is an explosive view of the plastic bag of FIG. 3.

Turning now to the drawings, FIG. 1 illustrates an apparatus for successively making plastic bags, according to the invention. Each of the plastic bags includes panel portions 1 and 2, side gusset portions 3 and a bottom gusset portion 4 and 5, as shown in FIG. 3 and as in the case of the plastic bag of Japanese Patent Publication No. 3,655,627. The panel portions 1 and 2 are superposed on each other, as shown in FIG. 4. Each of the panel portions 1 and 2 includes opposite side edges 6 along which the side gusset portions 3 extend. Each of the side gusset portions 3 is folded into halves, superposed into two layers and interposed between the panel portions 1 and 2. The panel portions 1 and 2 and the side gusset portions 3 are heat sealed with each other along the side edges 6 of panel portions 1 and 2 so that heat sealed lines 7 can be formed along the side edges 6 of panel portions 1 and 2. Each of the panel portions 1 and 2 further includes opposite end edges along one of which 8 and 9 the bottom gusset portion 4 and 5 extends. Each of the side gusset portions 3 has opposite end portions one of which is folded at an angle of 45° so that an auxiliary gusset portion 10 can be formed at one of the end portions. The bottom gusset portion 4 and 5 is combined with the auxiliary gusset portion 10.

In addition, one of the panel portions 1 is folded along a widthwise first folded line 11 to make the panel portions 1 and 2 open and make an open surface formed on the panel portions 1 and 2. One of the layers of side gusset portion 3 is folded along a widthwise side gusset folded line 12 to make the layers of side gusset portion 3 open, make the layers of auxiliary gusset portion 10 open and make an open surface formed on the layers of auxiliary gusset portion 10. Furthermore, one of the panel portions 1 and 2 is turned along a widthwise turned line 8 to make a turned portion 4 formed in one of the panel portions 1 and superposed on the open surfaces of panel portion 1 and auxiliary gusset portion 10. For example, one of the panel portions 1 is folded back along a widthwise folded back line 8 to make a folded back portion 4 formed in one of the panel portions 1 and superposed on the open surfaces of panel portion 1 and auxiliary gusset portion 10. In this case, the turned portion 4 comprises the folded back portion. The widthwise turned line 8 comprises the widthwise folded back line. The other panel portion 2 is folded along a widthwise second folded line 9 to make a folded portion 5 formed in the other panel portion 2 and superposed on the open surfaces of panel portion 2 and auxiliary gusset portion 10. The bottom gusset portion 4 and 5 is therefore formed by the turned portion 4 and the folded portion 5 and combined with the auxiliary gusset portion 10. One of the opposite end edges 8 and 9 of panel portions 1 and 2 is formed by the widthwise turned line 8 and the widthwise folded line 9 of panel portions 1 and 2. The bottom gusset portion 4 and 5 and the auxiliary gusset portions 10 are heat sealed with each other along the side edges 6 of panel portions 1 and 2 so that heat sealed lines 7 can be formed along the side edges 6 of panel portions 1 and 2.

The bottom gusset portion 4 and 5 comprises the turned portion 4 and the folded portion 5 including free end edges 13 and 14. The turned portion 4 and the folded portion 5 are folded along widthwise third and fourth folded lines 15 and 16 predetermined adjacent to the free end edges 13 and 14 of turned portion 4 and folded portion 5 so that considerable portions 17 and 18 can be formed between the free end edges 13 and 14 and the widthwise third and fourth folded lines 15 and 16 and superposed into two layers. The plastic bag includes an opening formed between bottom protrusions 17 and 18 protruding from the bottom gusset portion 4 and 5, the bottom protrusions 17 and 18 being formed by the considerable portions 17 and 18.

The respective lines 8, 9, 11, 12, 15 and 16 are parallel to each other.

In the plastic bag, the bottom gusset portion 4 and 5 includes opposite side edges contiguous to the end edges 8 and 9 of panel portions 1 and 2. The bottom protrusions 17 and 18 are formed between the side edges of bottom gusset portion 4 and 5. The widthwise first folded line 11 is spaced from the widthwise third and fourth folded lines 15 and 16 at a first distance. The widthwise turned line 8 is spaced from the third and fourth folded lines 15 and 16 at a second distance. The widthwise second folded line 9 is also spaced from the widthwise third and fourth folded lines 15 and 16 at the second distance. The second distance is half of the first distance. The bottom protrusions 17 and 18 are therefore formed at the center of the bottom gusset portion 4 and 5 widthwise thereof.

In addition, the plastic bag includes a zipper 19. The zipper 19 has been used generally in itself. The zipper 19 includes a male member formed integrally with a tape and fitted into a female member which is also formed integrally with a tape. The zipper 19 is interposed between the bottom protrusions 17 and 18 which are formed by the considerable portions 17 and 18, as described above. The bottom protrusions 17 and 18 are heat sealed with the tapes of mate and female members respectively so that heat sealed lines 20 and 21 can be formed along the zipper 19. One of the heat sealed lines 20 is formed on one of the opposite sides of male and female members. The other heat sealed line 21 is formed on the other side of male and female members and adjacent to the widthwise folded lines 15 and 16. It should therefore be understood that the plastic bag includes the opening formed by the zipper 19.

The plastic bag further includes an additional bottom gusset portion 22, as in the case of the plastic bag of Japanese Patent Publication No. 4,108,846. The bottom gusset portion 4 and 5 extends along one of the end edges 8 and 9 of panel portions 1 and 2 while the additional bottom gusset portion 22 extends along the other end edges 23. The additional bottom gusset portion 22 is folded into halves, superposed into two layers and interposed between the panel portions 1 and 2. In addition, each of the side gusset portions 3 has the other end portion folded at an angle of 45° so that an auxiliary gusset portion 24 can be formed at the other end portion, as in the case of one of the end portions of side gusset portion 3. The auxiliary gusset portion 24 is folded into halves, superposed into two layers and interposed between the layers of side gusset portion 3. The additional bottom gusset portion 22 is interposed between the layers of auxiliary gusset portion 24. The auxiliary gusset portion 24 and the additional bottom gusset portion 22 are heat sealed with each other along the side edges 6 of panel portions 1 and 2 so that heat sealed lines 7 can be formed along the side edges 6 of panel portions 1 and 2. The panel portions 1 and 2 and the additional bottom gusset portion 22 are heat sealed with each other along the other end edges 23 of panel portions 1 and 2 so that heat sealed lines 7 can be formed along the other end edges 23 of panel portions 1 and 2.

Figure 5:
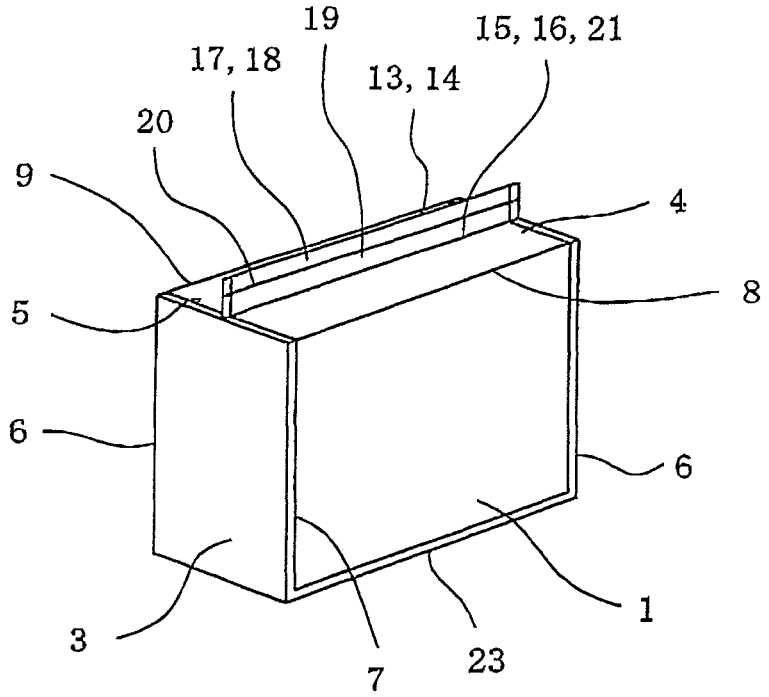
FIG. 5 is a perspective view of the plastic bag of FIG. 3 when being filled with content.

The plastic bag can therefore be enlarged by the side gusset portions 3 to obtain an increased capacity, as shown in FIG. 5. A flat bottom surface is formed by the additional bottom gusset portion 22 to make the plastic bag stand stably, when being filled with content. A flat top surface is formed by the bottom gusset portion 4 and 5 so that the plastic bag can be shaped into a rectangular parallelepiped to have an appearance of box. The plastic bag is therefore high in efficiency of being filled. The bottom protrusions 17 and 18 can be folded along the widthwise third and fourth folded lines 15 and 16 and superposed on the bottom gusset portion 4 or 5 after being filled so that the plastic bags can be pilled up conveniently.

In addition, the plastic bag includes the opening formed between the protrusions 17 and 18 of bottom gusset portion 4 and 5 for discharge of content. The zipper 19 can make the opening open and close.

Figure 2:
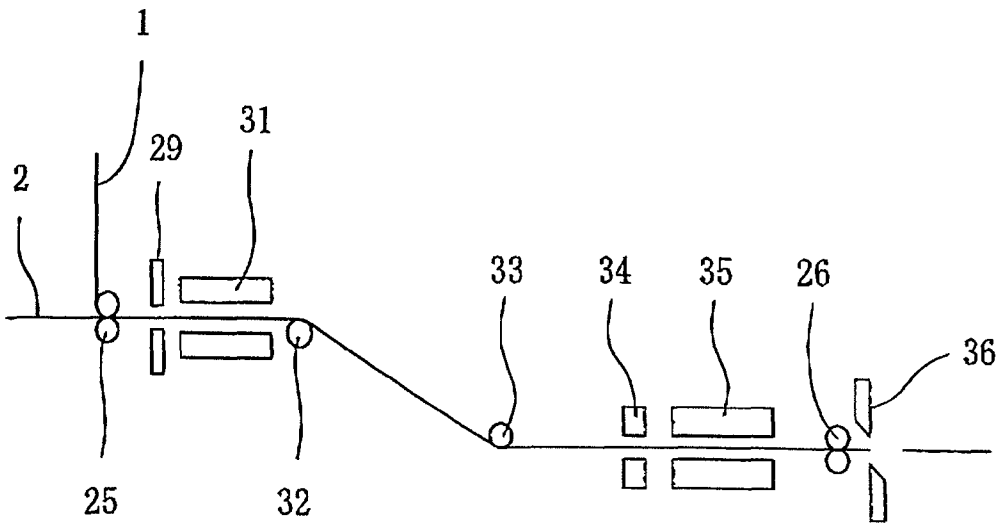
FIG. 2 is a side view of the apparatus of FIG. 1.

In order to successively make the plastic bags of FIG. 3, the apparatus includes panel material feeding means by which upper and lower webs of panel material 1 and 2 are opposed to and superposed on each other and fed longitudinally thereof and intermittently. Each of the webs of panel material 1 and 2 has opposite side edges 13, 14 and 22. The webs of panel material 1 and 2 comprise plastic films by which the panel portions 1 and 2 of FIG. 3 are formed. In the embodiment, the panel material feeding means comprises feed rollers 25 and 26, as shown in FIG. 2, the upper web of panel material 1 being supplied downwardly and directed to the feed rollers 25. The lower web of panel material 2 is supplied horizontally and directed to the feed rollers 25 so that the webs of panel material 1 and 2 can be opposed to and superposed on each other. The webs of panel material 1 and 2 are then directed to the feed rollers 26. The feed rollers 25 and 26 are rotated by a drive motor so that the webs of panel material 1 and 2 can be fed longitudinally thereof and intermittently.

The apparatus further includes side gusset material supply means 27 by which a sheet of side gusset material 3 is folded into halves, superposed into two layers and then supplied to and interposed between the webs of panel material 1 and 2 to extend widthwise thereof whenever the webs of panel material 1 and 2 are fed intermittently. The sheet of side gusset material 3 has opposite end portions one of which is spaced from one of the opposite side edges 13 and 14 of panel material 1 and 2. The sheet of side gusset material 3 comprises a plastic film by which the side gusset portion 3 and the auxiliary portions 10 and 24 of FIG. 3 are formed. In the embodiment, the sheet of side gusset material 3 has a double width, which is previously folded into halves on the opposite sides of the longitudinal centerline thereof to be superposed into two layers, as in the case of the apparatus of Japanese Patent Publication No. 3,655,627. The sheet of side gusset material 3 is supplied to and put on the lower web of panel material 2 to extend widthwise thereof before the webs of panel material 1 and 2 are superposed on each other and whenever the webs of panel material 1 and 2 are fed intermittently. The webs of panel material 1 and 2 are then superposed on each other so that the sheet of side gusset material 3 can be interposed between the webs of panel material 1 and 2. It should be noted that the side gusset material supply means 27 has the same structure as that of Japanese Patent Publication No. 3,655,627. No reference is therefore made to the structure herein.

In the embodiment, the sheet of side gusset material 3 is supplied by the side gusset material supply means 27 without making an auxiliary gusset portion 10 formed at one of the end portions of side gusset material 3. However, an auxiliary gusset portion 24 is formed at the other and portion of side gusset material 3 by making the other end portion folded at an angle of 45°.

The apparatus further includes additional bottom gusset material supply means 28 by which a web of additional bottom gusset material 22 is fed longitudinally thereof, folded into halves and supplied to and interposed between the webs of panel material 1 and 2 to extend longitudinally thereof. The web of additional bottom gusset material 22 comprises a plastic film by which the additional bottom portion 22 of FIG. 3 is formed. In the embodiment, the web of additional bottom gusset material 22 is supplied to and put on the lower web of panel material 2 and interposed between the layers of auxiliary gusset portion 24 to extend longitudinally of the lower web of panel material 2. The webs of panel material 1 and 2 are then superposed on each other so that the web of additional bottom gusset material 22 can be interposed between the webs of panel material 1 and 2.

The apparatus further includes temporarily fixing means by which one of the webs of panel material 1 is temporarily fixed to one of the layers of side gusset material 3, the other web of panel material 2 being temporarily fixed to the other layer of side gusset material 3 at one of the end portions of side gusset material 3 after the sheet of side gusset material 3 and the web of additional bottom gusset material 22 are interposed. For example, the temporarily fixing means comprises spot seal means 29 by which the upper web of panel material 1 is spot sealed with the upper layer of side gusset material 3 to be temporarily fixed thereto, the lower web of panel material 2 being spot sealed with the lower layer of side gusset material 3 to be temporarily fixed thereto at one of the end portions of side gusset material 3.

The apparatus further includes joint means by which the webs of panel material 1 and 2 are joined to each other along a longitudinal joint line predetermined adjacent to one of the opposite side edges 13 and 14 of panel material 1 and 2. In the embodiment, the apparatus further includes zipper supply means 30 by which a zipper 19 is fed longitudinally thereof and supplied to and interposed between the webs of panel material 1 and 2 to extend along the longitudinal joint line. For example, the zipper 19 is supplied to the lower web of panel material 2 to extend longitudinally thereof before the webs of panel material 1 and 2 are superposed. The webs of panel material 1 and 2 are then superposed on each other so that the zipper 19 can be interposed between the webs of panel material 1 and 2. The joint means comprises zipper seal means 31 by which the webs of panel material 1 and 2 and the zipper 19 are heat sealed with each other so that heat sealed lines 20 and 21 can be formed along the zipper 19. One of the heat sealed line 20 is formed on one of the opposite sides of the zipper 19 while the other heat sealed line 21 is formed on the other side of the zipper 19. The webs of panel material 1 and 2 are joined to each other by the zipper 19 at a position adjacent to the other sealed line 21. It should therefore be understood that the webs of panel material 1 and 2 are joined to each other along the longitudinal joint line formed by the zipper 19. Each of the webs of panel material 1 and 2 includes one of the side edges 13 and 14 by which the free end edges 13 and 14 of FIG. 3 are formed and the sealed lines 20 and 21 by which the sealed lines 20 and 21 of FIG. 3 are formed.

The apparatus further includes guide means by which each of the webs of panel material 1 and 2 is guided to be deformed from one of the side edges 13 and 14 after being temporarily fixed and joined and when being fed so that one of the webs of panel material 1 can be folded along a longitudinal first folded line 11 spaced from the longitudinal joint line. In addition, one of the webs of panel material 1 is turned along a longitudinal turned line 8 formed between the longitudinal joint line and the longitudinal first folded line 11 to make a turned portion 4 formed in one of the webs of panel material 1. In the embodiment, one of the webs of panel material 1 is folded along the longitudinal first folded line 11 and folded back along a longitudinal folded back line 8 to make a folded back portion 4 formed in one of the webs of panel material 1. The turned portion 4 comprises the folded back portion 4. The longitudinal turned line 8 comprises the longitudinal folded back line 8. At the same time, the other web of panel material 2 is folded along a longitudinal second folded line 9 spaced from the longitudinal joint line. The webs of panel material 1 and 2 are folded and turned under the condition of being joined to each other along the longitudinal joint line.

In the embodiment, the guide means comprises guide rollers 32 and 33, the webs of panel material 1 and 2 passing through the guide roller 32 to be directed to and pulled and lowered by the guide roller 33. In addition, the webs of panel material 1 and 2 are guided by the guide rollers 32 and 33 when being fed and under tension so that the upper web of panel material 1 can be folded along the longitudinal first folded line 11 to make the webs of panel material 1 and 2 open and make an open surface formed on the webs of panel material 1 and 2. In addition, the upper web of panel material 1 has been temporarily fixed to the upper layer of side gusset material 3, the lower web of panel material 2 being temporarily fixed to the lower layer of side gusset material 3 at one of the end portions of the side gusset material 3, as described previously. The upper layer of side gusset material 3 is therefore pulled by the upper web of panel material 1 folded along the longitudinal first folded line 11 while the lower layer of side gusset material 3 is held by the lower web of panel material 2 so that the sheet of side gusset material 3 is folded at an angle of 45° to make an auxiliary gusset portion 10 formed at the end portion, make the layers of side gusset material 3 open along with the auxiliary gusset portion 10 and make an open surface formed on the layers of auxiliary gusset portion 10, at one of the end portions of side gusset material 3. In addition, the upper web of panel material 1 is folded back and turned along the longitudinal turned line 8 to make the folded back or turned portion 4 formed in the upper web of panel material 1 and superposed on the open surfaces of the webs of panel material 1 and 2 and the layers of auxiliary gusset portion 10. At the same time, the lower web of panel material 2 is folded along the longitudinal second folded line 9 to make a folded portion 5 formed in the other web of panel material 2 and superposed on the open surfaces of the webs of panel material 1 and 2 and the layers of auxiliary gusset portion 10.

In addition, the longitudinal first folded line 11 is spaced from the longitudinal joint line at a first distance. The longitudinal turned line 8 is spaced from the longitudinal joint line at a second distance. The longitudinal second folded line 9 is also spaced from the longitudinal joint line at the second distance. The second distance is half of the first distance. The sheet of side gusset material 3 extends widthwise of the webs of panel material 1 and 2 so that one of the opposite end portions of side gusset material 3 can be spaced from the longitudinal joint line at the second distance. It should therefore be understood that the upper web of panel material 1 is folded along the longitudinal first folded line 11 to make the open surfaces on the webs of panel material 1 and 2 and the layers of auxiliary gusset portion 10, as described previously. In addition, the upper web of panel material 1 is folded back or turned along the longitudinal turned line 8 to make the turned portion 4 superposed on the open surface of panel material 1 and auxiliary gusset portion 10. The lower web of panel material 2 is folded along the second folded line 9 to make the folded portion 5 superposed on the open surfaces of panel material 2 and auxiliary gusset portion 10.

The turned portion 4 and the folded portion 5 are then kept being joined to each other along the longitudinal joint line and superposed on the open surfaces of panel material 1 and 2 and auxiliary gusset portion 10. The webs of panel material 1 and 2 includes the longitudinal first folded line 11, the longitudinal turned line 8 and the longitudinal second folded line 9 by which the widthwise first folded line 11, the widthwise turned line 8 and the widthwise second folded line 9 of FIG. 3 are formed.

In addition, the webs of panel material 1 and 2 include considerable portions 17 and 18 formed between the side edges 13 and 14 and the longitudinal joint line. The considerable portions 17 and 18 are folded along the longitudinal joint line to be superposed on the turned portion 4 under tension between the guide rollers 32 and 33 to make one of the widthwise third and fourth folded lines 15 and 16 of FIG. 3 formed. The considerable portions 17 and 18 may be folded reversely after making the plastic bag to make the other folded line formed. The plastic bag includes the bottom gusset portion 4 and 5 formed by the turned portion 4 and the folded portion 5 and the bottom protrusions 17 and 18 formed by the considerable portions 17 and 18.

The apparatus further includes cross seal means 34 by which the webs of panel material 1 and 2 and the sheet of side gusset material 3 are heat sealed with each other widthwise of the webs of panel material 1 and 2 after the webs of panel material 1 and 2 are folded and turned and whenever the webs of panel material 1 and 2 are fed intermittently. The turned portion 4 and the folded portion 5 are heat sealed with the auxiliary gusset portion 10, the web of additional bottom gusset material 22 being heat sealed with the auxiliary gusset portion 24, by the cross seal means 34. The apparatus further includes longitudinal seal means 35 by which the webs of panel material 1 and 2 and the web of additional bottom gusset material 22 are heat sealed with each other longitudinally of the webs of panel material 1 and 2 whenever the webs of panel material 1 and 2 are fed intermittently. The apparatus therefore makes the heat sealed line 7 of FIG. 3 formed.

The apparatus further includes a cutter 36 by which the webs of panel material 1 and 2 are cut widthwise thereof after the webs of panel material 1 and 2 are heat sealed and whenever the webs of panel material 1 and 2 are fed intermittently. They are cut at the position of side gusset portion 3. In the embodiment, the webs of panel material 1 and 2 and the sheet of side gusset material 3 are cut along the longitudinal centerline of side gusset material 3. The apparatus can therefore successively make the plastic bags of FIG. 3.

The plastic bag therefore includes the bottom gusset portion 4 and 5 formed by the turned portion 4 and the folded portion 5, the bottom protrusions 17 and 18 formed by the considerable portions 17 and 18 and the opening formed between the bottom protrusions 17 and 18. The plastic bag further includes the zipper 19 by which the opening is formed.

Figure 6:
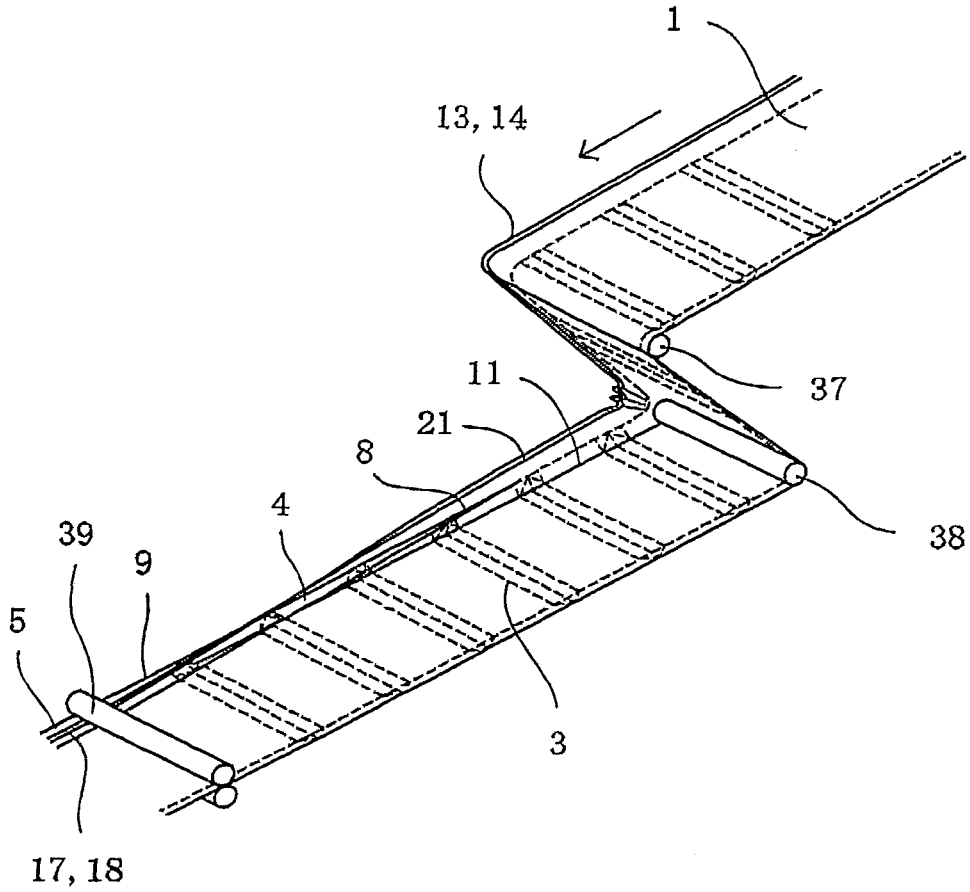
FIG. 6 is a perspective view of another embodiment.
Figure 7:
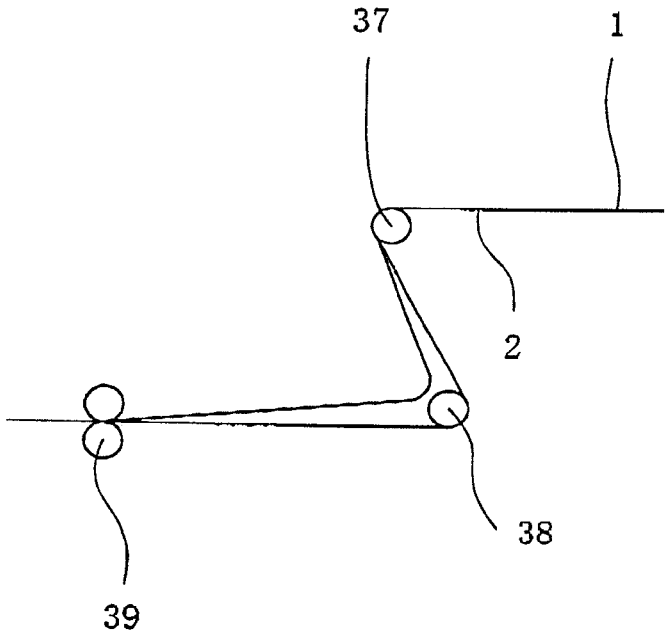
FIG. 7 is a side view of the apparatus of FIG. 6.

FIG. 6 illustrates another embodiment in which the guide means comprises guide rollers 37 and 38. The webs of panel material 1 and 2 pass through the guide roller 37 to be directed to and pulled and lowered by the guide roller 38, as in the case of the embodiment of FIG. 1. The guide roller 38 is cantilevered to have a free end disposed at the position of longitudinal first folded line 11. The webs of panel material 1 and 2 are changed in direction at an acute angle about the guide roller 37 and about the guide roller 38, as shown in FIG. 7. The webs of panel material 1 and 2 are then directed to and sandwiched between pinch rollers 39. The webs of panel material 1 and 2 are therefore guided by the guide rollers 37 and 38 and the pinch rollers 39 so that the upper web of panel material 1 can be deformed at the free end of guide roller 38 to be folded along the longitudinal first folded line 11 and folded back and turned along the longitudinal turned line 8. The lower web of panel material 2 is folded along the longitudinal second folded line 9. The considerable portions 17 and 18 are formed between the side edges 13 and 14 and the longitudinal joint line, folded along the longitudinal joint line and superposed on the turned portion 4.

In each of the embodiments of FIGS. 1 and 6, the apparatus may further include creasing means disposed upstream of the guide means so that the webs of panel material 1 and 2 can be directed to the creasing means to make creases formed along the longitudinal turned line 8 and the longitudinal second folded line 9. The apparatus may further include perforating means disposed upstream of the guide means so that the webs of panel material 1 and 2 can be directed to the perforating means to make perforations formed along the longitudinal turned line 8 and the longitudinal second folded line 9. In these case, the webs of panel material 1 and 2 are then folded, folded back and turned without difficulty when being guided by the guide means. It is preferable to make the turned portion 4 heat sealed along the longitudinal turned line 8 and make the folded portion 5 heat sealed along the longitudinal second folded line 9 after the perforations are formed along the longitudinal turned line 8 and the longitudinal second folded line 9 and the webs of panel material 1 and 2 are folded and turned, to be free of leakage from the perforations.

Figure 8:
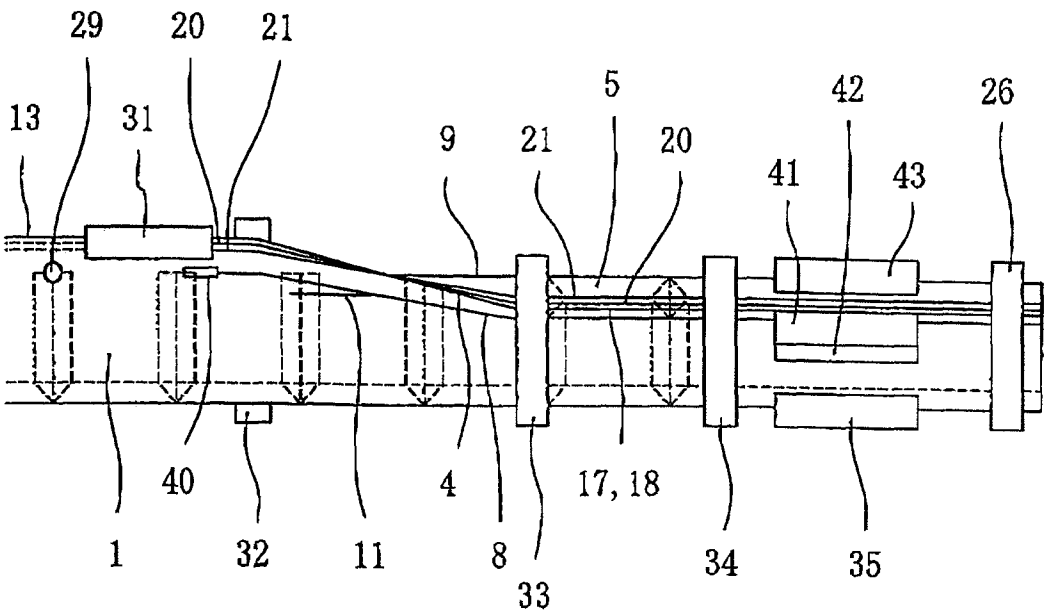
FIG. 8 is a plan view of another embodiment.
Figure 9:
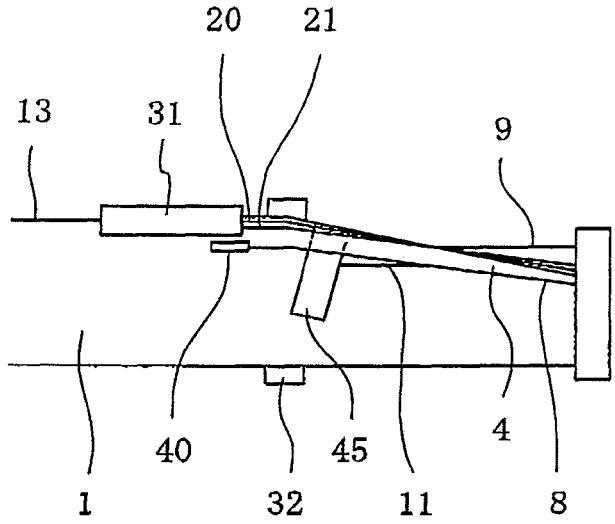
FIG. 9 is a plan view of another embodiment.

FIG. 8 illustrates another embodiment in which one of the webs of panel material 1 is directed to a slitting blade 40 to be slit along a longitudinal slit line 8 after being temporarily fixed and joined, for example in the embodiment of FIG. 1. The webs of panel material 1 and 2 are then guided by the guide means so that one of the webs of panel material 1 can be folded along the longitudinal folded line 11 to make the webs of panel material 1 and 2 open, the open surface formed on the webs of panel material 1 and 2, make the layers of side gusset material 3 open, make the auxiliary gusset portion 10 formed and make the open surface formed on the layers of auxiliary gusset portion 10. In this case, one of the webs of panel material 1 is slit and separated previously so that one of the webs of panel material 1 can be deformed from the longitudinal slit line 8 and folded along the longitudinal first folded line 11. One of the webs of panel material 1 is therefore turned eventually to make a turned portion 4 formed between the longitudinal joint line and the longitudinal slit line 8 and superposed on the open surfaces of panel material 1 and auxiliary gusset portion 10. The longitudinal turned line 8 comprises the longitudinal slit line 8. The other web of panel material 2 is folded along the longitudinal second folded line 9 to make the folded portion 5 superposed on the open surfaces of panel material 2 and auxiliary gusset portion 10.

Figure 10:
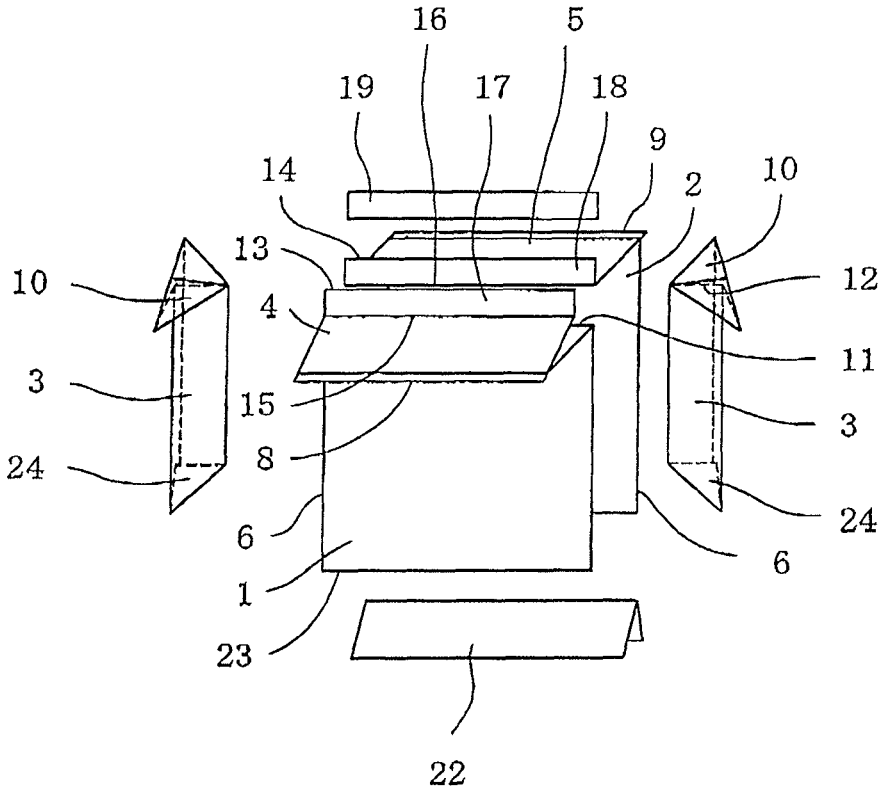
FIG. 10 is an explosive view of a plastic bag obtained by the apparatus of FIG. 8.

In addition, the webs of panel material 1 and 2 and the sheet of side gusset material 3 are heat sealed with each other by the cross seal means 34 after the webs of panel material 1 and 2 are folded and turned, as in the case of the embodiment of FIG. 1. The webs of panel material 1 and 2 and the web of additional auxiliary gusset material 22 are then heat sealed with each other by the longitudinal seal means 35. Furthermore, in the embodiment of FIG. 8, one of the webs of panel material 1 is directed to longitudinal seal means 41 so that the turned portion 4 can be heat sealed and closed along the longitudinal turned line 8 to restore one of the webs of panel material 1 slit. A plate 42 may be interposed between the folded portions of panel material 1 folded along the longitudinal first folded line 11 to make the turned portion 4 heat sealed as it is. The other web of panel material 2 may be directed to longitudinal heat seal means 43 to make the folded portion 5 heat sealed along the longitudinal second folded line 9. In this case, heat sealed lines are formed along the end edges 8 and 9 of panel portions 1 and 2, as shown in FIG. 10.

In the embodiment of FIG. 8, a spatula 45 may be inserted through the longitudinal slit line 8 so that the web of panel material 2 and the sheet of side gusset material 3 can be guided by the spatula 45 to be folded along the longitudinal second folded line 9 adequately after the web of panel material 1 is slit and when the webs of panel material 1 and 2 and the sheet of side gusset material 3 are folded by the guide rollers 32 and 33.

Figure 11:
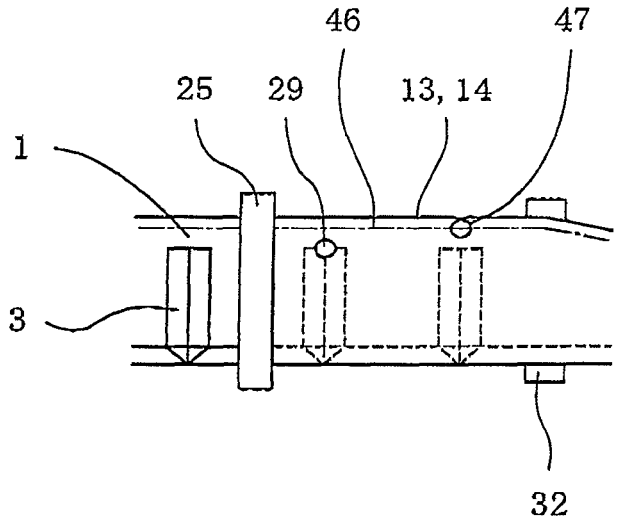
FIG. 11 is a plan view of another embodiment.
Figure 13:
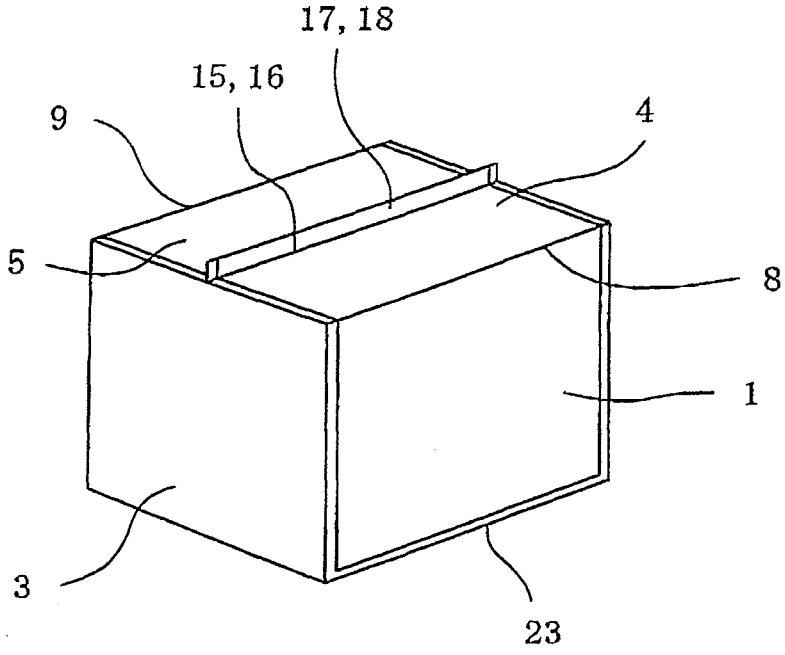
FIG. 13 is a perspective view of a plastic bag obtained by the apparatus of FIG. 11.

In each of the embodiments, it is not indispensable that the joint means comprises the zipper seal means 31. FIG. 11 illustrates another embodiment in which a longitudinal joint line 46 is predetermined adjacent to the side edges 13 and 14 of panel material 1 and 2. The joint means comprises spot seal means 47 disposed along the longitudinal joint line 46, by which the webs of panel material 1 and 2 are spot sealed with each other to be joined to each other at a position corresponding to the sheet of side gusset material 3 whenever the webs of panel material 1 and 2 are fed intermittently. The webs of panel material 1 and 2 are then guided by the guide means to be folded and turned so that the plastic bag can include the bottom protrusions 17 and 18 formed between the end edges 13 and 14 and the longitudinal joint line 46 and the opening formed between points at which the webs 1 and 2 are spot sealed, as shown in FIG. 13.

Figure 12:
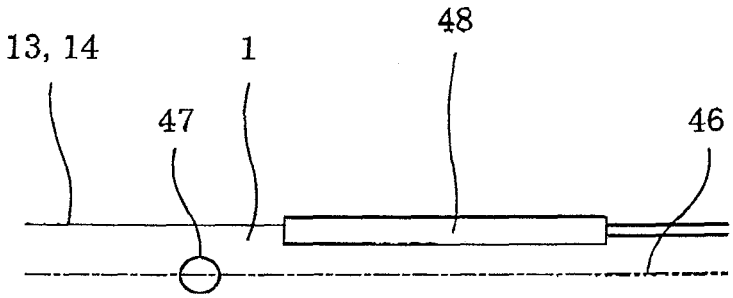
FIG. 12 is a plan view of another embodiment.

FIG. 12 illustrates another embodiment in which in addition to the spot seal means 47, the joint means includes longitudinal seal means 48 by which the webs of panel material 1 and 2 are heat sealed along the side edges 13 and 14 to be joined to each other. The webs of panel material 13 and 14 are then slit along the side edges 13 and 14 after being folded and turned, to make the heat sealed portion removed and the opening formed.

What is claimed is:

1. An apparatus for successively making plastic bags each of which includes panel portions, side gusset portions and a bottom gusset portion, each of the side gusset portions having opposite end portions at one of which an auxiliary gusset portion is formed, the bottom gusset portion being combined with the auxiliary gusset portion, the plastic bag further including an opening formed between bottom protrusions protruding from the bottom gusset portions, the apparatus comprising:

panel material feeding means by which upper and lower webs of panel material are opposed to and superposed on each other and fed longitudinally thereof and intermittently, each of the webs of panel material having first and second side edges, the panel portions being formed by the webs of panel material;

side gusset material supply means by which a sheet of side gusset material is folded into halves, superposed into two layers and then supplied to and interposed between the webs of panel material to extend widthwise thereof whenever the webs of panel material are fed intermittently, the sheet of side gusset material having opposite end portions one of which is spaced from the first side edge of panel material, the side gusset portion and the auxiliary gusset portion being formed by the sheet of side gusset material;

temporarily fixing means by which one of the webs of panel material is temporarily fixed to one of the layers of side gusset material, the other web of panel material being temporarily fixed to the other layer of side gusset material, at one of the end portions of side gusset material after the sheet of side gusset material is interposed;

joint means by which the webs of panel material are joined to each other along a longitudinal joint line predetermined adjacent to the first side edge of panel material; and guide means by which each of the webs of panel material is guided to be deformed from the first side edge thereof after being temporarily fixed and joined and when being fed so that one of the webs of panel material can be folded along a longitudinal first folded line spaced from the longitudinal joint line to open the webs of panel material and form a surface on the webs of panel material, one of the layers of side gusset material being folded along the longitudinal first folded line to open the layers of side gusset material along with the auxiliary gusset portion and form a surface on the layers of auxiliary gusset portion, one of the webs of panel material being turned along a longitudinal turned line formed between the longitudinal joint line and the longitudinal first folded line to make a turned portion formed in one of the webs of panel material and superposed on the surface of the webs of panel material and the surface of the layers of auxiliary gusset portion, the other web of panel material being folded along a longitudinal second folded line spaced from the longitudinal joint line to make a folded portion formed in the other web of panel material and superposed on the surface of the webs of panel material and the surface of the layers of auxiliary gusset portion, the bottom gusset portion being formed by the turned portion and the folded portion, the opening being formed between the bottom protrusions which are formed between the first side edges of panel material and the longitudinal joint line.

2. The apparatus as set forth in claim 1 wherein one of the webs of panel material is folded along the longitudinal first folded line and folded back along a longitudinal folded back line to make a folded back portion formed in one of the webs of panel material, the turned portion comprising the folded back portion, the longitudinal turned line comprising the longitudinal folded back line.

3. The apparatus as set forth in claim 1 wherein one of the webs of panel material is slit along a longitudinal slit line after being temporarily fixed and joined, one of the webs of panel material being then folded along the longitudinal first folded line, the turned portion being formed between the longitudinal joint line and the longitudinal slit line, the longitudinal turned line comprising the longitudinal slit line.

4. The apparatus as set forth in claim 1 further comprising:

cross seal means by which the webs of panel material and the sheet of side gusset material are heat sealed with each other widthwise of the webs of panel material after the webs of panel material are folded and turned and whenever the webs of panel material are fed intermittently.

5. The apparatus as set forth in claim 4 further comprising:

additional bottom gusset material supply means by which a web of additional bottom gusset material is supplied to and interposed between the webs of panel material to extend longitudinally thereof; and longitudinal seal means by which the webs of panel material and the web of additional bottom gusset material are heat sealed with each other longitudinally of the webs of panel material whenever the webs of panel material are fed intermittently, the plastic bag further including an additional bottom gusset portion formed by the web of additional bottom gusset material.

6. The apparatus as set forth in claim 5 further comprising:

a cutter by which the webs of panel material are cut widthwise thereof after the webs of panel material are heat sealed and whenever the webs of panel material are fed intermittently.

7. The apparatus as set forth in claim 1 further comprising:

zipper supply means by which a zipper is supplied to and interposed between the webs of panel material to extend along the longitudinal joint line, the joint means comprising zipper seal means by which the webs of panel material and the zipper are heat sealed with each other so that the webs of panel material can be joined to each other, the opening being formed by the zipper.

8. The apparatus as set forth in claim 1 wherein the joint means comprises spot seal means by which the webs of panel material are spot sealed with each other to be joined to each other at a position corresponding to the sheet of side gusset material whenever the webs of panel material are fed intermittently, the opening being formed between points at which the webs of panel material are spot sealed.

9. The apparatus as set forth in claim 1 wherein the longitudinal first folded line is spaced from the longitudinal joint line at a first distance, the longitudinal turned line being spaced from the longitudinal joint line at a second distance, the longitudinal second folded line being also spaced from the longitudinal joint line at the second distance, the second distance being half of the first distance, the sheet of side gusset material extending widthwise of the webs of panel material so that one of the end portions of side gusset material can be spaced from the longitudinal joint line at the second distance.

* * * * *